United States Patent [19]

McHattie et al.

[11] Patent Number: 4,668,034

[45] Date of Patent: May 26, 1987

[54] GROUNDING CLAMP FOR ELECTRICAL DUPLEX RECEPTACLE MOUNTED IN A METAL OUTLET BOX

[76] Inventors: Earl E. McHattie, 2129 Midlothian Rd.; William A. Muska, 1378 Ryan Ave., both of Roseville, Minn. 55113

[21] Appl. No.: 860,992

[22] Filed: May 8, 1986

[51] Int. Cl.[4] ..... H01R 3/06

[52] U.S. Cl. ..... 339/14 R; 339/123; 174/51

[58] Field of Search ..... 339/14 R, 147 R, 147 C, 339/121, 122 R, 122 F, 123, 263 R; 174/51, 55

[56] References Cited

U.S. PATENT DOCUMENTS

| | | | |
|---|---|---|---|
| 2,427,349 | 9/1947 | Boynton | 339/123 |
| 2,768,232 | 10/1956 | Kwake | 174/51 |
| 3,663,919 | 5/1972 | Jaconette | 339/14 R |
| 3,723,939 | 3/1973 | Schleicher | 339/14 R |
| 3,786,399 | 1/1974 | McHattie | 339/14 R |
| 3,917,899 | 11/1975 | Oliver | 339/122 R X |

*Primary Examiner*—Z. R. Bilinsky

*Attorney, Agent, or Firm*—Jacobson and Johnson

[57] ABSTRACT

Clamping strips are attached to the underside of the cover of a metal electrical outlet box for holding the ears of an electrical duplex receptacle grounded mounting strap, which is located on the underside of the cover plate, securely and with low electrical resistance against the underside of the cover plate.

9 Claims, 6 Drawing Figures

GROUNDING CLAMP FOR ELECTRICAL DUPLEX RECEPTACLE MOUNTED IN A METAL OUTLET BOX

FIELD OF THE INVENTION

This invention is directed toward providing and securing a good and firm mounting and electrical ground path for an electrical duplex receptacle which is mounted in an all-metal outlet box.

DESCRIPTION OF THE PRIOR ART

Conventionally, a duplex receptacle contained in an all-metal outlet box is attached to the underside of the cover plate of the outlet box by a single mounting screw threadably engaged in a threaded recess located between the two halves of the receptacle. The mounting screw also provides a safety grounding path between the receptacle and the outlet box through the cover plate. Experience has shown that after being in use the mounting screw may loosen and therefore the electrical ground which it provides as a safety feature may be unreliable. In order to assure a reliable and continuous safety electrical ground for the receptacle, the safety codes have now made it mandatory to run a separate electrical lead from a ground terminal on the receptacle directly to the outlet box. This not only makes the cost of installation more expensive but at times it has been found that the tradesman may be in a hurry and may overlook making this safety connection.

SUMMARY

In conventional fashion a duplex receptacle is located on the underside of the cover plate of a metal outlet box and may be held in place by a mounting screw which passes through the cover plate into engagement with a threaded recess located between the two halves of the receptacle. Also, conventionally, the duplex receptacle has a metal mounting strap with ears extending out from each end of the receptacle on the underside of the cover plate. The mounting strap is electrically connected to the ground sockets of the receptacles. In accordance with the teachings of this invention, a strip of rigid material is attached in some convenient fashion to the underside of the box cover plate and rests over each extending ear of the receptacle mounting strap to clamp the ears securely and firmly against the underside of the cover plate thereby keeping it mechanically secure and ensuring a good electrical grounding connection between the metal mounting strap and the cover plate of the outlet box. With the receptacle clamped in position in this fashion there is little or no likelihood that it can work loose. But even if it should, the clamp still maintains a large area of electrical contact between the mounting strap ears and the cover plate of the outlet box so that a good electrical ground still remains. Preferably the clamp strip is made of metal and provides a further electrical grounding path between the mounting bracket and the outlet box.

DESCRIPTION OF THE PREFERRED EMBODIMENTS

In the following detailed description like parts are identified by the same reference number.

Figure 1:
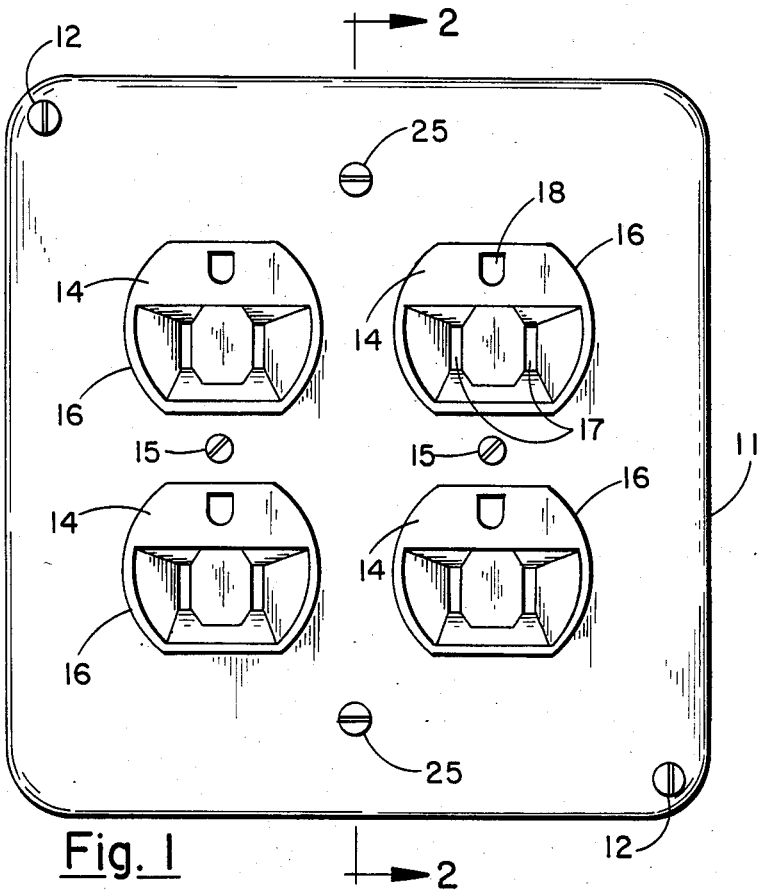
FIG. 1 is a top plan view of an outlet box showing a cover plate with a pair of duplex receptacles mounted thereon.
Figure 2:
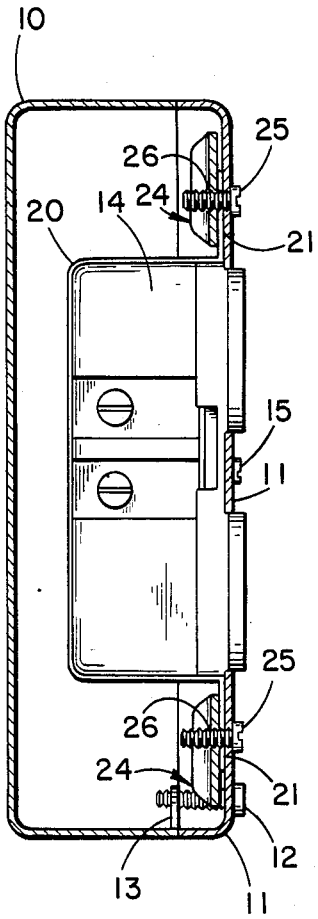
FIG. 2 is a section view taken along viewing lines 2—2 of FIG. 1.

Referring first primarily to FIGS. 1 and 2, conventionally a metal outlet box comprises a metal rectangular enclosure 10 closed in on the sides and bottom and open at the top and a metal cover plate 11 which is removably attached to the top edge of the enclosure 10 by diagonally opposite screws 12 threaded into lugs 13. The enclosure 10 has knockouts, not shown, which are removed to provide openings for electrical wiring into the interior of the outlet box. In addition, of course, means, not shown, are provided for mounting the enclosure 10 to a suitable supporting structure. Also, conventionally, enclosure 10 is electrically grounded in some fashion to the system ground. Typically and conventionally, a pair of duplex electrical receptacles 14 are mounted side-by-side to the underside of cover plate 11 by mounting screws 15. Also, conventionally, access openings 16 for each half of the duplex receptacles are provided in the cover plate 11. Each half of the duplex receptacles has three sockets for mating with corresponding male prongs of an electrical plug which is at the end of a three-wire cable which is normally attached to a piece of electrical equipment. Typically, sockets 17 provide the energizing current path to the electrical equipment and socket 18 provides a safety grounding path for the third wire. Each duplex receptacle has a conventional rigid mounting strap or yoke 20 which is connected to a ground terminal 23 (FIG. 3) on the receptacle which in turn is electrically connected internally, by means not shown, to the ground sockets 18. Mounting strap 20 has ears 21 extending outward from each end of the receptacle which rest against the underside of the cover plate 11.

Conventionally, a threaded recess in the receptacle, not shown, in which mounting screw 15 is threadably engaged is also internally connected to ground sockets 18 in the receptacles. In the past this single mounting screw 15 was relied upon to provide the safety electrical ground path from the receptacle to the cover plate 11 and, via mounting screws 12, to the enclosure 10 for maintaining the receptacle at electrical ground for safety reasons. Because experience has shown that after a period of time the mounting screw 15 can work loose so that the safety grounding path is no longer assured, it became a requirement that an additional safety grounding path be provided by a wire connection directly from ground terminal 23 on the receptacle to enclosure 10. This requires an electrical lead to be mechanically fastened to enclosure 10 and then when the receptacle is attached the lead must be connected to ground terminal 23. The instant invention provides an additional or alternate means for holding a duplex receptacle securely in place on the cover plate 11 and for insuring and maintaining a secure safety ground path for the receptacle.

Figure 3:
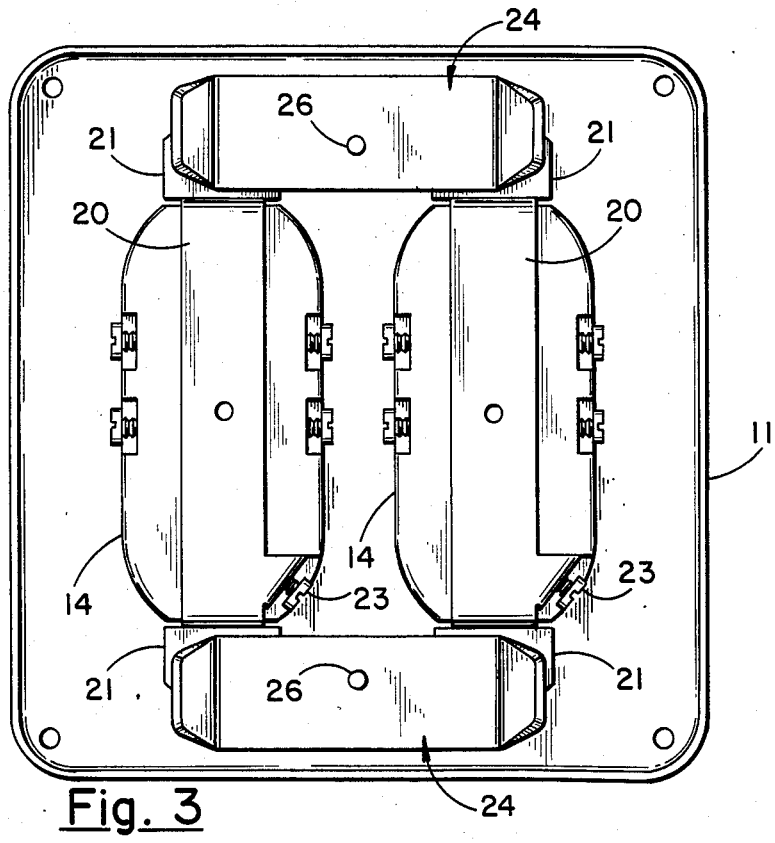
FIG. 3 is a view of the underside of the cover plate showing a preferred embodiment of the invention.
Figure 4:
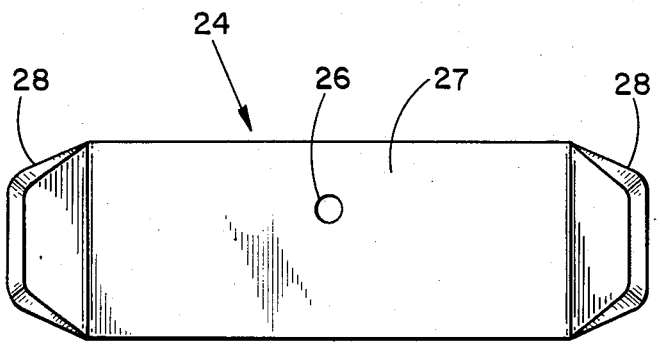
FIG. 4 is an illustration of a preferred embodiment of the clamping strip.
Figure 5:
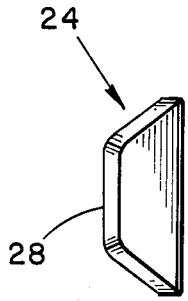
FIG. 5 is an end view of the strip illustrated in FIG. 4.

Referring particularly to FIGS. 2 and 3, a pair of rigid clamping strips 24, preferably made of a suitable electrically conductive metal and illustrated in FIGS. 4 and 5, is attached to the underside of cover plate 11 by mounting screws 25 which pass through the cover plate 11 and engage an internally threaded opening 26 in strip 24. Each of the strips 24 is constructed to extend over a corresponding ear 21 of mounting bracket 20 on each of the receptacles 14 and each is brought to clamp firmly against the ears by the tightening of screws 25. This securely clamps and holds the mounting brackets 20 and their associated receptacles 14 in place and presses the ears 21 against the underside of the mounting plate 11 to provide a low resistance conductive path between them. Further, metal clamping strips 24 establish another low resistance electrical path between ears 21 and strips 24 and then to cover plate 11 via the threaded screws 25.

Preferably, clamping strips 24 have a flat middle body portion 27 which extends from the screw attachment over the ears 21 and flared wings 28 at each end to make it easy to slip the mounting strap ears 21 under the flat portion 27 when installing the receptacles.

In practice it is preferred that the clamp strips 24 are normally attached loosely to the cover plate 11 preferably by mounting screws 25 having upset or crimped threads at the outer end to prevent the screw and associated clamping strip from separating and to locate the position of the clamp strip for quick and easy installation of the receptacle. To install the receptacles, the ears 21 of the receptacle mounting straps 20 are slipped under the winged ends 28 and flat portion 27 so that the two halves of the duplex receptacles rest in openings 16 in cover plate 11 and then mounting screws 25 are tightened down to securely clamp the ears of the mounting bracket 20 in place between clamping strips 24 and the underside of cover plate 11.

Figure 6:
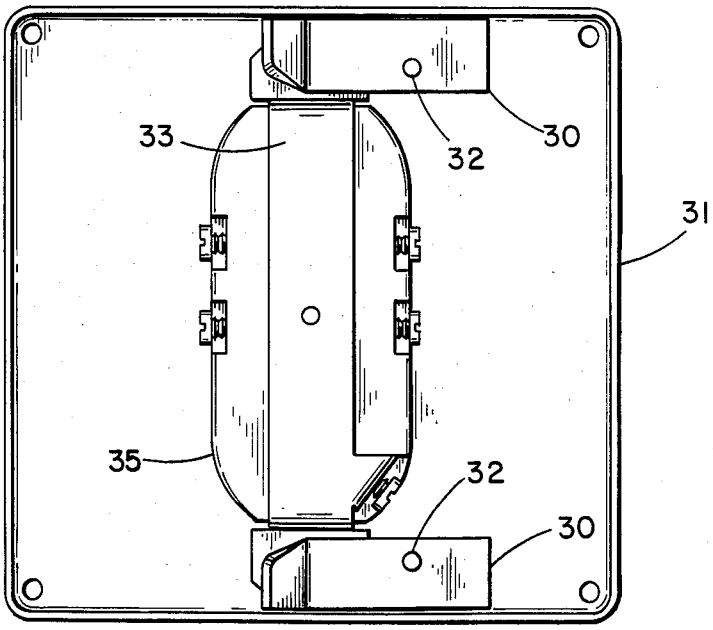
FIG. 6 is a view of the underside of a cover plate showing an embodiment of the invention with a single duplex receptacle.

While the invention has been illustrated hereto in conjunction with a pair of duplex receptacles in an outlet box, it is quite common to have a single duplex receptacle mounted in an outlet box. FIG. 6 shows the underside of a cover plate for an outlet box with a single duplex receptacle 35 installed. The clamp strips 30 are attached to the underside of the cover plate 31 by screws, not shown, passing through cover plate 31 and threadably engaging a suitable threaded opening 32 in strips 30. The strips 30 extend from the mounting screws over the ears of the receptacle grounded mounting strap 33. In some larger size boxes, if room permits, the threaded openings 32 for the clamp strip mounting screws may be located generally along the longitudinal center line of the receptacle instead of off to a side of the receptacle as illustrated in FIG. 6.

I claim:

1. In combination, an electrically conductive cover plate for an outlet box for a duplex electrical receptacle, said cover plate having access openings for each half of the receptacle;

a duplex electrical receptacle having a grounded metal mounting strap with ears at each end extending out from the receptacle body, said receptacle located on the underside of the cover plate with the ears of the mounting strap resting against the underside of said cover plate;

a pair of rigid strips on the underside of said cover plate, each strip extending over an ear of said mounting strap; and means for securing each of said strips to said cover plate for clamping the mounting strap ears between said strips and the underside of said cover plate.

2. The invention as described in claim 1 wherein said rigid strips are electrically conductive.

3. The invention as described in claim 1 further including:

an open-top metal enclosure and means for removably attaching and electrically connecting said cover plate to the top of said enclosure.

4. The invention as described in claim 1 wherein the means for securing each of the clamping strips to said cover plate comprises a screw passing through said cover plate and threadably engaged with a threaded opening in said strip.

5. The invention as described in claim 1 wherein each of said clamping strips comprises a flat body portion and at least one winged end angled away from the underside of the cover plate.

6. The invention as described in claim 2 wherein said means for securing each of said strips to said cover plate comprises electrically conductive means.

7. In a metal electrical outlet box having a duplex receptacle mounted to the underside of the box cover plate, said receptacle having an electrically grounded mounting strap with ears extending out from each end of the receptacle body and resting against the underside of the cover plate, clamps for said mounting strap ears, comprising:

a pair of rigid strips on the underside of said cover plate, each strip extending over an ear of said mounting strap; and means for securing each of said strips to said cover plate for clamping the mounting strap ears between said strips and the underside of said cover plate.

8. The invention as described in claim 7 wherein said strips are electrically conductive.

9. The invention as in claim 8 wherein said means for securing said strips to said cover plate is electrically conductive.

* * * * *